United States Patent [19]

Nienow et al.

[11] 4,033,360

[45] July 5, 1977

[54] APPARATUS PROVIDING OUTPUT INDICATION OF TOBACCO ROD FIRMNESS

[75] Inventors: John F. Nienow; Charles T. Higgins; Leo F. Meyer, all of Richmond, Va.

[73] Assignee: Philip Morris Incorporated, New York, N.Y.

[22] Filed: Dec. 5, 1975

[21] Appl. No.: 638,080

[52] U.S. Cl. ..... 131/21 B; 73/88.5 R
[51] Int. Cl.[2] ..... A24B 7/14; A24C 5/32
[58] Field of Search ..... 131/21 B, 21 R, 21 D; 73/88.5 R

[56] References Cited

UNITED STATES PATENTS

| | | | |
|---|---|---|---|
| 2,522,117 | 9/1950 | Holt et al. | 131/21 B |
| 2,667,172 | 1/1954 | Broekhuysen et al. | 131/21 B |
| 3,411,348 | 11/1968 | Schulthets, Jr. | 73/88.5 R X |

OTHER PUBLICATIONS

Beckwith & Buck, Mechanical Measurements, 1961, pp. 128, 129.

*Primary Examiner*—Stephen C. Pellegrino
*Attorney, Agent, or Firm*—Watson, Leavenworth, Kelton & Taggart

[57] ABSTRACT

Strain gages are applied to opposite sides of the cantilever beam member of a short tongue in such locations that the strain gages exhibit stress changes of opposite sense on movement of the short tongue compression foot occasioned by a change in tobacco rod firmness. An existing short tongue is modified by provision of a reduced section in its cantilever beam for amplifying the signal output of a strain gage supported therein. Plural pairs of strain gages may be employed for further amplification of the signal indicating compression foot movement.

11 Claims, 9 Drawing Figures

PRIOR ART

APPARATUS PROVIDING OUTPUT INDICATION OF TOBACCO ROD FIRMNESS

FIELD OF THE INVENTION

This invention relates to cigarette making machinery and more particularly to apparatus providing continuous output indication of the relative firmness of a tobacco rod during manufacture of cigarettes.

BACKGROUND OF THE INVENTION

In monitoring the firmness of tobacco rods in cigarette manufacture, the industry has made extended use of compacimeters (compactness meters) whereby exacting "off-line" measurements can be made on manufactured cigarettes without intervention in the making process. In its further efforts to provide tobacco rod firmness information more contemporaneous with cigarette manufacture, thereby to enable adjustment or correction of the parameters of the making process concurrently with information gathering, the industry has looked further to various "on-line" systems and apparatus. Versions of pneumatic apparatus are shown in U.S. Pats. No. 3,411,513, No. 3,595,067, No. 3,633,590 and No. 3,850,029 and in British Pat. No. 1,372,056. These devices are (1) of type employing floating nozzles issuing pressurized air onto the cigarette wrapper and either measure deformation of the wrapper or displacement of the nozzle based on the change in back pressure and (2) of type providing a pressurized on-line chamber arrangement and observing pressure changes caused by variation of firmness or dimensions of cigarettes passing therethrough.

Alternate, non-pneumatic approaches to firmness measurement are set forth in U.S. Pat. No. 2,667,172 and South African Patent Application No. 73/9394. The devices of the 2,667,172 patent and such patent application look toward the use of tobacco rod forming elements of existing maker machinery for the additional function of providing output indication of rod firmness. In the 2,667,172 patent, elongate short tongue 60 includes strain gages 116 and **116*a* positioned proximate its compression foot and distal from short tongue support clamp or beam 101. These gases are in spaced longitudinal alignment whereby longitudinal pressures exerted by tobacco against the tongue may be sensed. This sensing apparatus is separate in function and operation from the tobacco rod firmness sensing apparatus of the 2,667,172 patent. The latter apparatus comprises a single active strain gage 84,** also disposed between the tongue support beam and foot and adapted to provide output indication of vertical strain placed on the short tongue, i.e., movements of its foot transverse to the direction of movement of tobacco engaged thereby. The South African patent application relates also to specially constructed short tongues, disclosing a first embodiment wherein the compression foot of a short tongue is split into two successive longitudinal sections, each having a separate support flange with one support flange having a strain gage thereon, and a further embodiment wherein the longitudinally forward of such compression foot sections is further split into three circumferential segments, each having an independent support flange with a strain gage thereon. Such support flanges are stems having one end terminating at the compression foot and an opposite end terminating at the tongue cantilever support beam.

SUMMARY OF THE INVENTION

It is an object of the present invention to provide simplified on-line tobacco rod firmness measuring apparatus.

In attaining the foregoing and other objects, the invention provides for the introduction of strain gage apparatus directly on the cantilever support beam of a short tongue, such apparatus preferably having plural strain gages respectively oppositely stressed upon movement of the short tongue foot radially of the tobacco rod engaged thereby to indicate change in firmness. The firmness indication provided in accordance with the invention may be further amplified by nominal modification of the support beam of existing short tongue of commercial equipment and still further by particular circuit interconnection of plural pairs of strain gages.

Pursuant to the invention, strain gages are located on the cantilever beam itself, an approach disparate from that of the referenced 2,667,172 patent and South African patent application which provide for strain gage placement beyond such beam, and necessitate specialized short tongue structure. In its attainment of firmness indication of accuracy commensurate with that of off-line apparatus, the invention detects change in the condition of flexure of such beam member responsive to compression foot movement.

The output stress change signals of the cantilever beam-supported strain gages may be employed to control a meter or like indicating instruments, may be recorded or may serve to control tobacco supply or like on-like apparatus.

The foregoing and other objects and features of the invention will be further understood from the following detailed description of preferred embodiments of the invention and from the drawings wherein like reference numerals identify like parts throughout.

DESCRIPTION OF THE PREFERRED EMBODIMENTS

Figure 1:
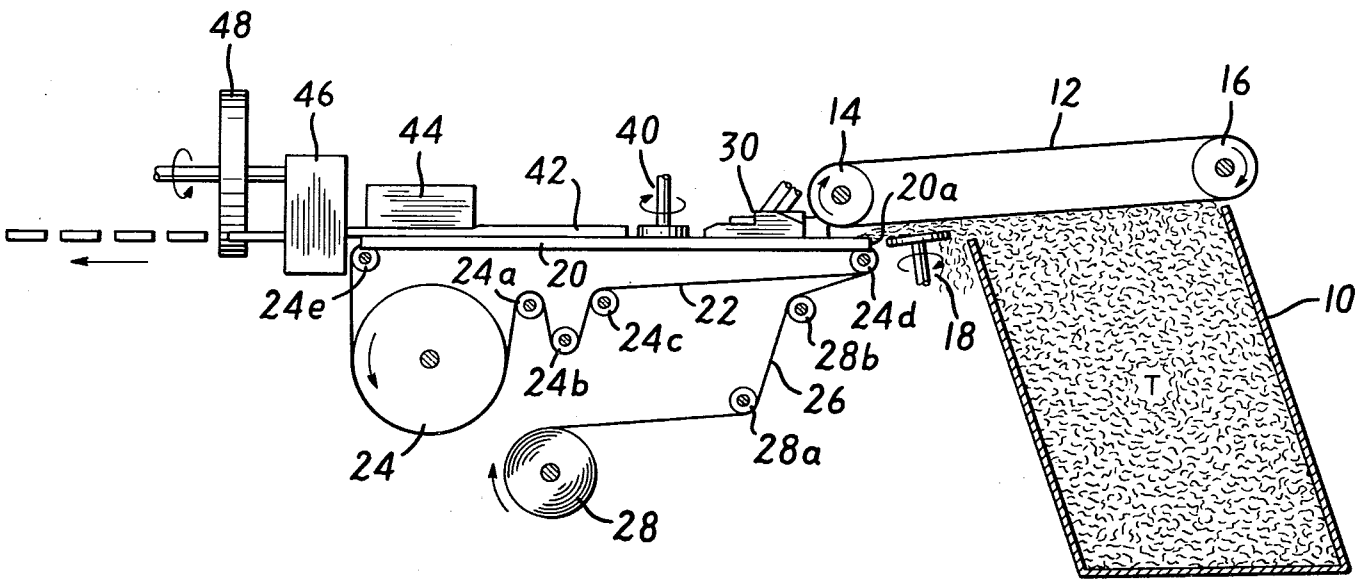
PRIOR ART FIG. 1
FIG. 1 is a schematic illustration of cigarette making apparatus in present commercial use.

Referring to FIG. 1, cigarette making apparatus, known as the MK8 Cigarette Maker and commercially-available from the Molins Company, is shown schematically to include tobacco chimney 10 from whic tobacco is blown onto perforated vacuum belt 12 driven by rollers 14 and 16 to convey tobacco T supported by belt 12 to trimmer knive assembly 18 supported for movement toward or away from the conveyed tobacco to vary the amount of tobacco on belt 12 in accordance with a cigarette weight (density)-based control signal.

Leftwardly of roller 14, such Molins apparatus includes elongate garniture 20 defining an open channel extending longitudinally and of generally semi-cylindrical configuration. Endless garniture tape or belt 22 is fed to upstream tobacco input mouth 20a of the garniture and transported through the garniture by drive wheel 24 over idler rollers 24a-24e. Cigarette paper 26 is fed to mouth 20a atop tape 22 from supply roll or bobbin 28 over idler rollers 28a, 28b and 24d. Tobacco falls from belt 12 onto paper 26 as vacuum is removed from the belt. On entry of tape 22 in the garniture channel, the garniture imports generally semi-cylindrical shape thereto, like shape being thereby imparted to paper 26 and the tobacco deposited thereon from belt 12, the open semi-circular cross-section of the tape, paper and tobacco being shown in FIG. 6.

Figure 2:
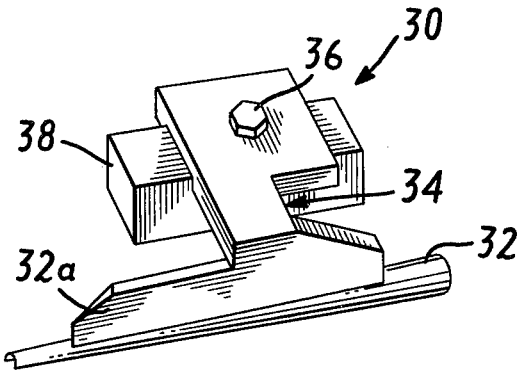
FIG. 2 is a perspective view of the short tongue of the FIG. 1 apparatus.

Short tongue 30 of such Molins apparatus (FIGS. 1 and 2), comprising compression foot 32 and cantilever beam member or arm 34, is located downstream of garniture mouth 20a. This unit is cooperative with the garniture to impart generally cylindrical form to the tobacco to form a tobacco rod. To this end, compression foot 32 defines an open channel extending longitudinally therein and also of generally semi-cylindrical configuration, the open semi-circular cross-section of such channel being shown in FIG. 6. One end of beam 34 is fixedly secured, as by bolt 36 to base 38 (FIG. 2) and the opposite end of beam 34 is integral, or otherwise in supporting relation, with stem 32*a* of compression foot 32.

As the formed tobacco rod leaves short tongue 30, a length of cigarette paper extends tangentially from the paper-wrapped rod. Paster wheel 40 applies an adhesive to such extending length of paper whereupon unit 42 folds such pasted length over and unit 44 heat seals the rod. The sealed continuous rod now passes thrugh nuclear density gage 46 and is then cut by rod cut-off mechanism 48.

Figure 3:
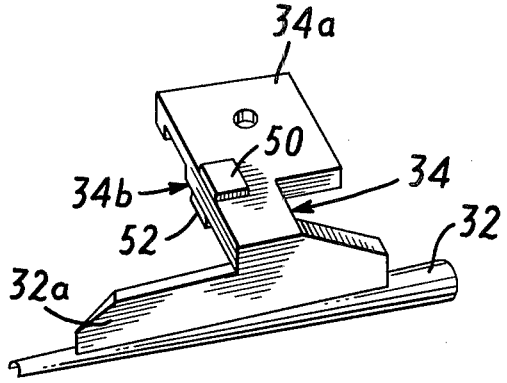
FIG. 3 is a further perspective view of the FIG. 2 short tongue adapted in accordance with the invention for tobacco rod firmness measuring.

In FIG. 3, strain gages 50 and 52 are supported, in accordance with the invention, on opposed sides 34a and 34b of beam 34 at locations on the beam at which the beam exhibits flexure on movements upwardly from a quiescent position, i.e., a position wherein no upward stress is in the beam.

Strain gages 50 and 52 are preferably employed with a beam 34' (FIG. 4) which differs from beam 34 of FIG. 3 by inclusion of a longitudinal extent 34'*a* of reduced cross-sectional area with respect to portions 34'*b* and 34'*c* of beam 34' extending longitudinally adjacent such extent 34'*a*. In this construction, strain gage 50 is supported on land 34'*f* of beam extent 34'*a* and strain gage 52 is supported thereunder on land 34'*g*. Preferably, separate strain gages 50*a* and 50*b* are supported on land 34'*f*, as shown in FIG. 5. The underside opposed land supports strain gages 52*a* and 52*b* (not shown in FIG. 5).

Figure 6:
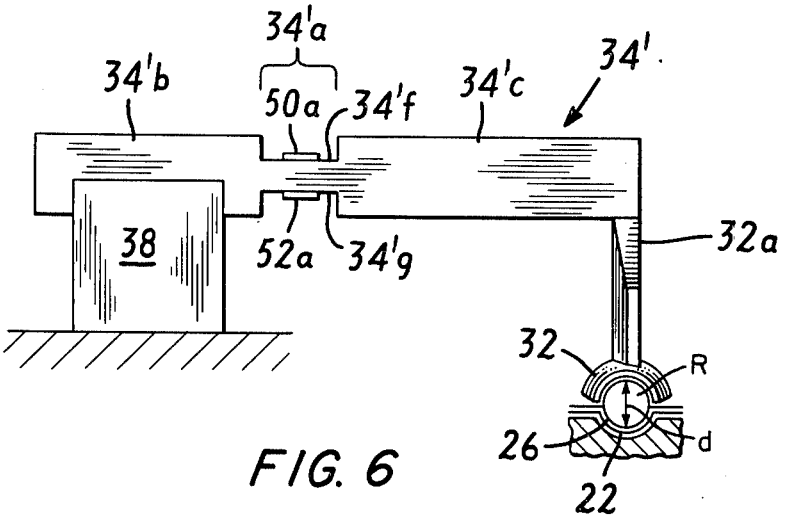
FIG. 6 is a schematic side illustration of the FIG. 4 short tongue in its quiescent position.
Figure 7:
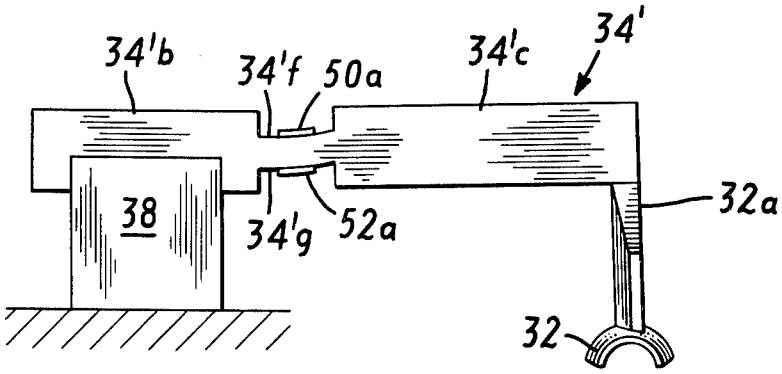
FIG. 7 is an exaggerated illustration of the condition of flexure of the beam member of the FIG. 4 short tongue.

In the aforesaid quiescent position for beam 34 or beam 34' compression foot 34 is thereby supported to engage a tobacco rod of substantially less diameter *d* than a predetermined desired diameter, as is shown schematically in FIG. 6, in such manner that the strain gages on opposed surfaces of the beam exhibit equal electrical resistance. Thus, in FIG. 6 tobacco rod R is of such predetermined diameter *d* and beam 34 is in such position that it is unflexed. FIG. 7 shows schematically and in exaggerated manner, a movement of beam 34' upwardly of its quiescent position, occasioned by foot 32 engaging a rod having diameter greater than diameter *d*, wherein flexure of beam 34' elongates land 34'g and contracts land 34'f. As a result, the strain gage(s) on land 34'*g* is subjected to tension while the strain gage(s) on land 34'*f* is subjected to compression. On movement of compression foot 32 and its support beam downwardly of its FIG. 7 position, as occurs when engaged tobacco rod firmness decreases from that applying in FIG. 7, compression in the strain gage(s) on land 34'*g* will increase while tension in the strain gage(s) on land 34'*f* will increase.

Figure 4:
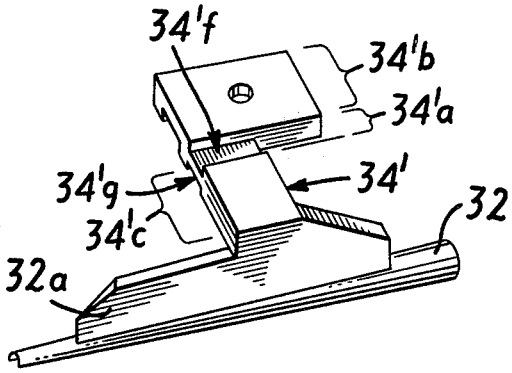
FIG. 4 is a perspective view of the short tongue modified in accordance with the invention.
Figure 5:
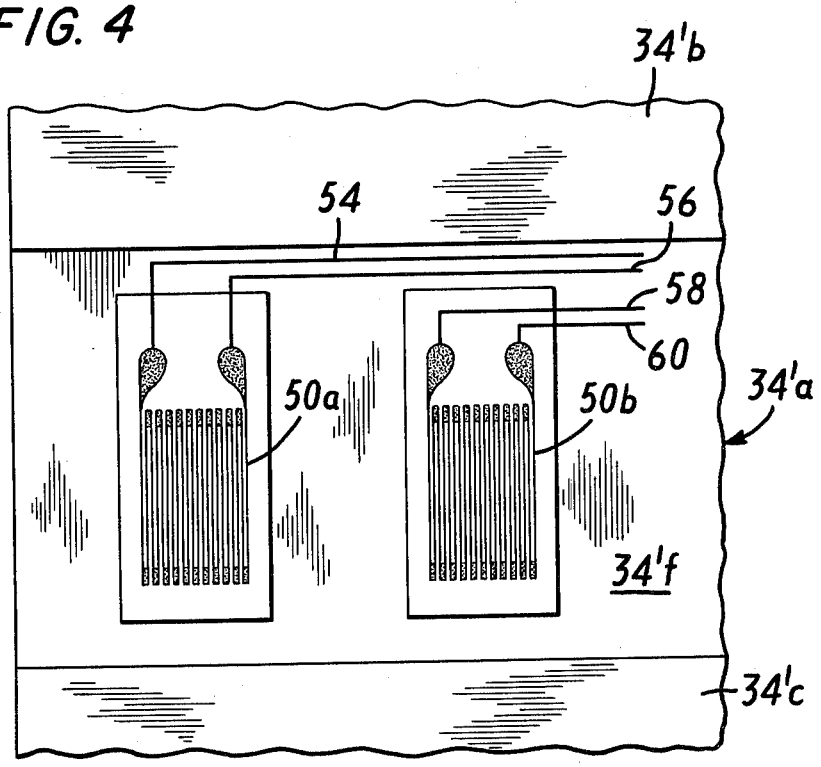
FIG. 5 is a partial plan view of the short tongue of FIG. 4 with plural strain gages employed in accordance with the invention.
Figure 8:
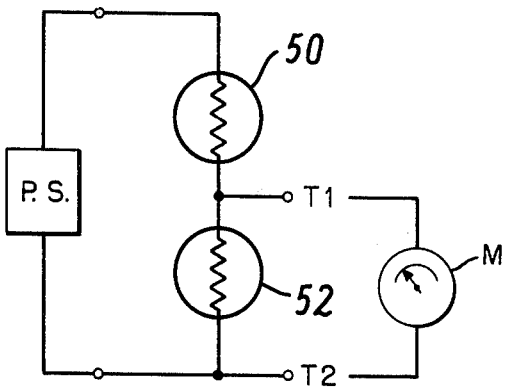
FIG. 8 shows a circuit for use in providing tobacco rod firmness indication.
Figure 9:
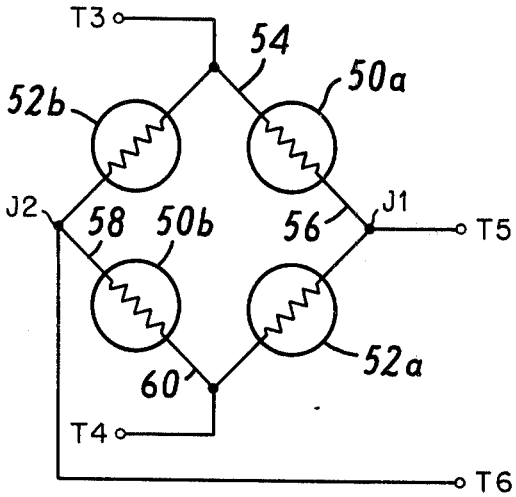
FIG. 9 shows a further circuit arrangement wherein plural pairs of strain gages are employed.

As will be appreciated, lands 34'f and 34'g experience greater surface extent change for a given flexure condition in beam 34' than longitudinally adjacent beam portions 34'*b* and 34'*c*. Accordingly, the beam construction shown in FIGS. 4–6 enables the strain gages to exhibit a change in resistance for a given beam flexure exceeding that resistance change which they would exhibit were they supported, as in the FIG. 3 embodiment, on surfaces of the beam not of reduced cross-sectional area.

Where used in the embodiment shown in FIG. 3 or the embodiments shown in FIGS. 4–6, a single pair of strain gages (50, 52) are connected in manner shown in FIG. 8, i.e., they are series-connected and supplied with voltage from a suitable power supply P.S. with an output signal being provided at terminals T1 and T2, indicative of the voltage across an exclusive one of the strain gages. By such connection of the single pair of strain gages, mounted in plural on the cantilever beam 34 or 34' and in manner exhibiting respectively opposite changes in stress condition for change in flexure condition of the beam, an amplified signal is obtained at terminals T1 and T2. Thus, if strain gage 50 is compressed, thereby decreasing its resistance, while strain gage 52 is subjected to tension at the same time, thereby increasing its resistance, the voltage across terminals T1 and T2 will increase in compound manner, i.e., increasing on one hand, by decrease in the resistance of strain gage 50 and, on the other hand, by increase in resistance of strain gage 52. As will be further seen, based on such signal amplification, less sensitivity to change is required in associated detector equipment, for example, rod firmness indicating meter M, and the signal-to-noise ratio may desirably be increased.

Where strain gages are employed in pairs on opposed sides of beam 34 or 34' as shown in FIG. 5, the gages are connected as in FIG. 9. A full bridge circuit includes one branch having gages 50*a* and 52*a* connected in series and another branch having gages 52*b* and 50*b* connected in series, the branches being connected in parallel between terminals T3 and T4. A power supply is connected across T3 and T4 and an output signal is provided by terminals T5 and T6, T5 being connected to the junction J1 of gages 50*a* and 52*a* and T6 to the junction J2 of gages 50*b* and 52*b*.

The reversed order of connection of strain gages in the FIG. 9 circuit provides signal amplification increased above that of FIG. 8. In such reversed order, one gage (50*a*) on the upper beam side is in the upper portion of the first branch and the remaining upper beam side gage (50*b*) is in the lower portion of the second branch. One gage (52*b*) on the lower beam side is in the upper portion of such second branch and the remaining lower beam side gage (52*a*) is in the lower portion of such first branch.

Assuming the change in flexure conditions in FIGS. 6 and 7 to be the tobacco rod firmness change under examination, the resistances of gages 50*a* and 50*b* will decrease and the resistances of gages 52*a* and 52*b* will increase. The voltage at junction J1 with respect to junction T4 will increase in magnitude and the voltage at junction J2 with respect to T4 will decrease in magntidue by that same amount. The voltage change between T5 and T6 will thus be twice that seen at either junction separately.

Considering beam 34′ to be stable in its first flexure condition in FIG. 7 and tobacco rod firmness to then change such that the beam assumes a second flexure condition between its FIG. 7 and its FIG. 6 states, tension in the gage(s) on land 34′g decreases from that applying in the first flexure condition, i.e., relative compression thereof increases from that applying in the first flexure condition. Similarly, in the second flexure condition compression in the gage(s) on land 34′f decreases, i.e., relative tension increases therein. Otherwise stated, movement of foot 32 is accompanied by stress changes of opposite sense (compression vs. tension) in the respective top and bottom strain gage(s).

In practicing the invention, the strain gages are preferably foil strain gages, such as are commercially available as model number MA-06-062AA-120 (gage factor 2.075) from Micro-Measurements Division of Vishay Intertechnology, Inc., Box 306, Romulus, Michigan.

Various changes and modifications may be introduced in the foregoing particularly described embodiments without departing from the invention. Such embodiments are thus intended in a descriptive and not in a limiting sense. The true spirit and scope of the invention is set forth in the following claims.

What is claimed is:

1. In cigarette making apparatus of type having a garniture for imparting curvature to a garniture tape, and thereby to cigarette paper and tobacco disposed on said tape, and short tongue means including (a) a foot member engageable with said tobacco and cooperative with said garniture for imparting generally cylindrical shape to said tobacco to form a tobacco rod (b) a base member fixedly supported in said apparatus and (c) an elongate beam member fixedly secured at one end thereof to said base member, said one end being thereby restrained against movement, and supporting said foot member at the other end thereof for movements according with change in firmness of said tobacco rod, the improvement comprising first and second strain gage means supported on respective opposed sides of said beam member in such locations that said first strain gage exhibits stress change of sense opposite to the stress change exhibited by said second strain gage means on such movement of said foot member.

2. The invention claimed in claim 1 further comprising circuit means for connecting said first and second strain gage means in a series circuit, for applying a voltage across said series circuit and for providing an output signal indicative of the voltage across a selective one of said strain gage elements.

3. The invention claimed in claim 1 wherein eachof said strain gage means comprises first and second strain gages, said invention further comprising circuit means for connecting in a first series circuit the first strain gage of said first strain gage means and the first strain gage of said second strain gage means, for connecting in a second series circuit the second strain gage of said second strain gage means and the second gage of said first strain gage means, for connecting said first series circuit in parallel circuit with said second series circuit, for applying a voltage across said parallel circuit and for providing an output signal indicative of the voltage difference between the respective junctions of strain gages in said first and second series circuits.

4. The invention claimed in claim 1 wherein said improvement further comprises the provision in said beam member of a longitudinal extent of cross-sectional area reduced with respect to portions of said beam member longitudinally adjacent said reduced area extent thereof, said first and second strain gage-means being supported on respective opposed sides of said beam member reduced area extent.

5. The invention claimed in claim 1 wherein said beam member is integral with said foot member.

6. In cigarette making apparatus of type having a garniture for imparting curvature to a garniture tape, and thereby to cigarette paper and tobacco disposed on said tape, and short tongue means including a foot member engageable with said tobacco and cooperative with said garniture for imparting generally cylindrical shape to said tobacco to form a tobacco rod, and a base member fixedly supported in said apparatus the improvement comprising an elongate beam member in said short tongue means having a longitudinal extent of cross-sectional area reduced with respect to portions of said beam member longitudinally adjacent said reduced area extent, said beam member being fixedly secured at one end thereof to said base member, said one end being thereby restrained against movement, and supporting said foot member at the other end thereof for movements according with change in firmness of said tobacco rod, and strain gage means supported on said beam member reduced area extent.

7. The invention claimed in claim 6 wherein said strain gage means comprises first and second strain gages supported on respective opposed sides of said beam member reduced area extent in such locations that said first strain gage exhibits stress change of sense opposite to the stress change exhibited by said second strain gage on such movement of said foot member.

8. The invention claimed in claim 7 further comprising circuit means for connecting said first and second strain gages in a series circuit, for applying a voltage across said series circuit and for providing an output signal indicative of the voltage across a selective one of said strain gages.

9. The invention claimed in claim 7 wherein said beam member in integral with said foot member.

10. The invention claimed in claim 6 wherein said strain gage means comprises a first pair of strain gages supported on one side of said beam member reduced area extent and a second pair of strain gages supported on a side of said beam member reduced area extent opposite said one side thereof, said invention further including circuit means for connecting one strain gage of said first pair and one strain gage of said second pair in a first series circuit, for connecting the remaining strain gages of said second and first pairs in a second series circuit, for connecting said first series circuit in parallel circuit with said second series circuit, for applying a voltage across said parallel circuit and for providing an output signal indicative of the voltage difference between the respective junctions of strain gages in said first and second series circuits.

11. The invention claimed in claim 6 wherein said beam member is integral with said foot member.

* * * * *